US005385405A

United States Patent [19]

Hobbs et al.

[11] Patent Number: 5,385,405

[45] Date of Patent: Jan. 31, 1995

[54] FLOATING ROLLER RETAINER ASSEMBLY FOR SLIDES

[75] Inventors: James D. Hobbs, Plainfield; James M. Lentz, Beech Grove; Richard E. Karr, Indianapolis, all of Ind.

[73] Assignee: General Devices Co., Inc., Indianapolis, Ind.

[21] Appl. No.: 72,815

[22] Filed: Jun. 7, 1993

[51] Int. Cl.[6] ..... A47B 88/00

[52] U.S. Cl. ..... 384/19

[58] Field of Search ..... 384/19, 18, 48, 49, 384/50, 58

[56] References Cited

U.S. PATENT DOCUMENTS

| | | | |
|---|---|---|---|
| 2,319,555 | 5/1943 | Premo . | |
| 2,496,673 | 2/1950 | Nielsen . | |
| 2,728,626 | 12/1955 | Gussack . | |
| 2,788,253 | 4/1957 | Gussack . | |
| 2,848,294 | 8/1958 | Sandberg . | |
| 2,880,040 | 3/1959 | Gomersall | 384/19 |
| 3,035,873 | 5/1962 | Fall . | |
| 3,059,978 | 10/1962 | Fall . | |
| 3,092,429 | 6/1963 | Barnes . | |
| 3,142,517 | 7/1964 | Ward . | |
| 3,450,446 | 6/1969 | Fall et al. . | |
| 3,464,744 | 9/1969 | Fall . | |
| 3,485,539 | 12/1969 | Fall et al. . | |
| 3,488,097 | 1/1970 | Fall . | |
| 3,521,939 | 7/1970 | Fall et al. . | |
| 3,679,275 | 7/1972 | Fall et al. . | |
| 3,687,505 | 8/1972 | Fall et al. . | |
| 3,701,577 | 10/1972 | Fischer . | |
| 3,738,716 | 6/1973 | Lambert . | |
| 3,776,608 | 12/1973 | Fall et al. . | |
| 3,801,166 | 4/1974 | York . | |
| 3,869,184 | 3/1975 | Lambert et al. . | |
| 3,937,531 | 2/1976 | Hagen et al. . | |
| 3,950,040 | 4/1976 | Fall . | |
| 4,004,841 | 1/1977 | Vander Ley . | |
| 4,057,303 | 11/1977 | Röck et al. | 384/19 |
| 4,089,568 | 5/1978 | Fall . | |
| 4,101,178 | 7/1978 | Adams et al. . | |
| 4,200,342 | 4/1980 | Fall . | |
| 4,549,773 | 10/1985 | Papp et al. . | |
| 4,560,212 | 12/1985 | Papp et al. . | |
| 4,872,734 | 10/1989 | Rechberg . | |

FOREIGN PATENT DOCUMENTS

| | | |
|---|---|---|
| 2532532 | 3/1984 | France . |
| 803331 | 10/1958 | United Kingdom . |

OTHER PUBLICATIONS

"Jonathan Steel-Slides and Packaging Accessories", Jonathan Manufacturing Corporation, California, two pages, date unknown.

*Primary Examiner*—Thomas R. Hannon

*Attorney, Agent, or Firm*—Barnes & Thornburg

[57] ABSTRACT

A roller assembly for use in a telescoping slide assembly having at least two slide members that are slidably interconnected for movement along the longitudinal axis of the slide assembly, the roller assembly comprising a plurality of rollers for maintaining vertical spacing between the interconnected slide members, a spacer maintaining lateral spacing between the interconnected slide members, formed to include a first vertical side wall having a first opening, a second vertical side wall having a second opening, and a laterally extending open-ended aperture interconnection the first and second openings, the second means further including a bearing loosely received in the laterally extending open-ended aperture for lateral sliding movement relative to the spacer and arranged to extend through each of the first and second openings, and side walls for longitudinally aligning the plurality of rollers, positioned to lie adjacent to the rollers for longitudinally aligning the rollers so that the rollers roll along the same path without overlapping.

36 Claims, 2 Drawing Sheets

FLOATING ROLLER RETAINER ASSEMBLY FOR SLIDES

BACKGROUND AND SUMMARY OF THE INVENTION

The present invention relates to roller assemblies for use in telescoping slide assemblies having multiple interconnected slide members, the slide assembly extending and retracting along a longitudinal axis of the slide assembly. The invention particularly relates to roller assemblies having a plurality of vertical rollers rotatable about a horizontal axis for movement parallel to the longitudinal axis of the slide assembly, side walls for maintaining the vertical rollers in longitudinal alignment and preventing overlap, and a horizontal roller rotatable about a vertical axis.

Telescoping slide assemblies are used to support loads such as drawers, trays, equipment racks or the like for movement between a retracted position and an extended position. The slide assemblies include interconnected slide members that extend and retract relative to each other along a longitudinal axis of the slide assembly. Typically, a stationary slide member is rigidly attached to a floor or platform, and a load-carrying slide member is attached to the load to be moved. The load-carrying slide member is slidably coupled to an intermediate slide member that is, in turn, slidably coupled to the stationary slide member. Thus, the interconnected slide members cooperate to permit the load to be moved along the longitudinal axis of the slide assembly between a retracted position and an extended position.

Friction between the interconnected slide members can become a major impediment to smooth operation of the slide assembly. It is known to use vertical rollers in the telescoping slide assemblies to reduce friction and thereby increase ease of operation. See, for example, U.S. Pat. No. 3,485,539 to Fall et al., U.S. Pat. No. 3,464,744 to Fall, and U.S. Pat. No. 3,450,466 to Fall et al.

Typically, vertical rollers are oriented to rotate about a horizontal axis and are positioned in channels located between side walls of the interconnected slide members. Vertical rollers alone can improve the ease of operation, but lateral movement of the slide member can reduce the effectiveness of the vertical rollers. Lateral movement of the slide members relative to each other can pinch the vertical rollers on one side of the slide assembly, increasing friction, while allowing room for the vertical rollers on the other side of the assembly to become skewed relative to each other and overlap. When the vertical rollers overlap, they can become wedged, further increasing friction. Of course, when rollers become wedged, the force required to extend or retract the telescoping slide assembly increases dramatically. In extreme cases, the slide assembly locks up and is unable to extend or retract.

In one attempt to minimize lateral movement of the slide members relative to each other to prevent pinching of the vertical rollers, selected vertical rollers were formed to include a central aperture, and a ball bearing was fitted into each aperture. See, for example, U.S. Pat. No. 3,464,744 to Fall. The combination of ball bearings and vertical rollers was successful in eliminating the pinching problem, but was expensive in terms of manufacturing and inventory management costs. Moreover, while the pinching was eliminated, it was still possible for the rollers to become skewed relative to each other and overlap, and the end rollers were still allowed to fall behind.

To eliminate the overlapping problem, it was necessary to maintain the rollers in longitudinal alignment so that each roller moved along the same path, one after another. Applicant experimented with one method which was to remove the ball bearings and place a pair of longitudinally extending side walls alongside the vertical rollers. A rivet connected the side walls through the central aperture of the end rollers. Unfortunately, while the side walls eliminated the overlapping problem, the side walls were subject to being pinched by lateral movement of the slide members.

In order to eliminate the pinching problem while maintaining the side walls to control overlapping, applicant further experimented with bushings incorporated into the mechanism as a replacement for the rivets. The bushings extended laterally beyond the side walls and provided lateral separation to prevent pinching the side walls. Thus, the combination of side walls and bushings solved the pinching and overlapping problems. Moreover, since the ball bearings were no longer needed, the number of parts required was reduced. Unfortunately, the bushings tended to wear excessively and were subject to binding.

Another problem associated with vertical rollers used in telescoping slide assemblies is failure of all of the roller to roll equally due to uneven surfaces on which the rollers move. The surfaces are formed by welding a track to the outer surface of the side walls of the slide members. Those tracks then fit into recesses formed in the side walls of the adjacent slide members. Variations in the surface of the track occur due to unequal heating of the track and slide member during welding. As a result of the uneven track surfaces, the end rollers can lag behind the rest of the rollers as the slide assembly extends or retracts. When the end rollers fall behind, the slide members end up skidding the end roller along, increasing friction, and in severe cases, locking up the slide assembly.

Advantageously, coupling side walls to the end rollers by rivets or bushings solved the problem by keeping all of the rollers together as the slide assembly extended or retracted. However, it was found that the rollers were subject to banging into each other at the end of the assembly travel during extension and retraction, temporarily deforming the rollers and causing flat spots to form on the rollers. In extreme cases, the flat spots were permanently formed on the rollers. When flat spots formed on the rollers, the distance between the end rollers was temporarily reduced. Since the ends of the side walls were coupled to the end rollers, the ends were squeezed toward each other to match the temporarily reduced distance between the end rollers. When the side walls were squeezed, they buckled like an accordian. Buckling of the side walls reduced the clearance between the slide members and the side walls and caused the slide assemblies to lock up.

A roller assembly that provides for longitudinal alignment of the rollers while keeping the rollers moving together and maintaining lateral separation between the slide members would be appreciated by operators of slide assemblies. An assembly that provides those features while eliminating squeezing of the side walls to prevent buckling would be a substantial improvement over conventional assemblies.

The present invention provides a roller assembly for use in a telescoping slide assembly having at least two slide members that are slidably interconnected for movement along the longitudinal axis of the slide assembly. The roller assembly includes first means for maintaining vertical separation between the slide members and second means for maintaining lateral separation between the slide members. The invention also provides third means for longitudinally aligning the first means.

The first means includes a plurality of rollers oriented to rotate about a horizontal axis and the second means includes a bearing oriented to rotate about a vertical axis. The plurality of rollers includes a pair of end rollers, with each end roller having a central aperture.

The third means includes longitudinally extending side walls positioned adjacent the rollers, the side walls having coined segments. The side walls are coupled to the end rollers by a roller insert positioned in the central aperture of the end rollers and a rivet extending through the insert to engage the coined segments.

Additional objects, features, and advantages of the invention will become apparent to those skilled in the art upon consideration of the following detained description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
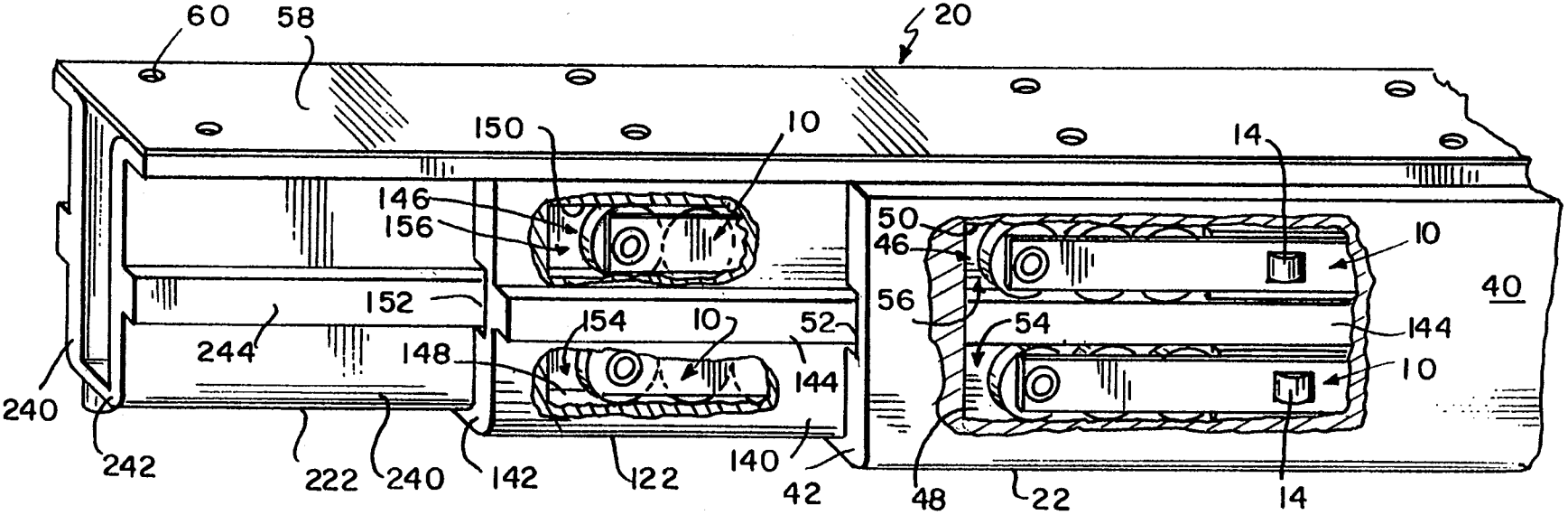
FIG. 1 is a perspective view of a telescoping slide assembly partially broken away showing the floating roller retainer assembly positioned between interconnected slide members.

A plurality of floating roller assemblies 10 are shown in FIG. 1 operably positioned in a telescoping slide assembly 20 for use in supporting drawers, trays, equipment racks or the like in a cabinet or mobile platform. The slide assembly includes interconnected slide members 22, 122, 222, and the roller assemblies 10 are positioned to provide horizontal and vertical separation between the interconnected slide members 22, 122, 222.

Figure 2:
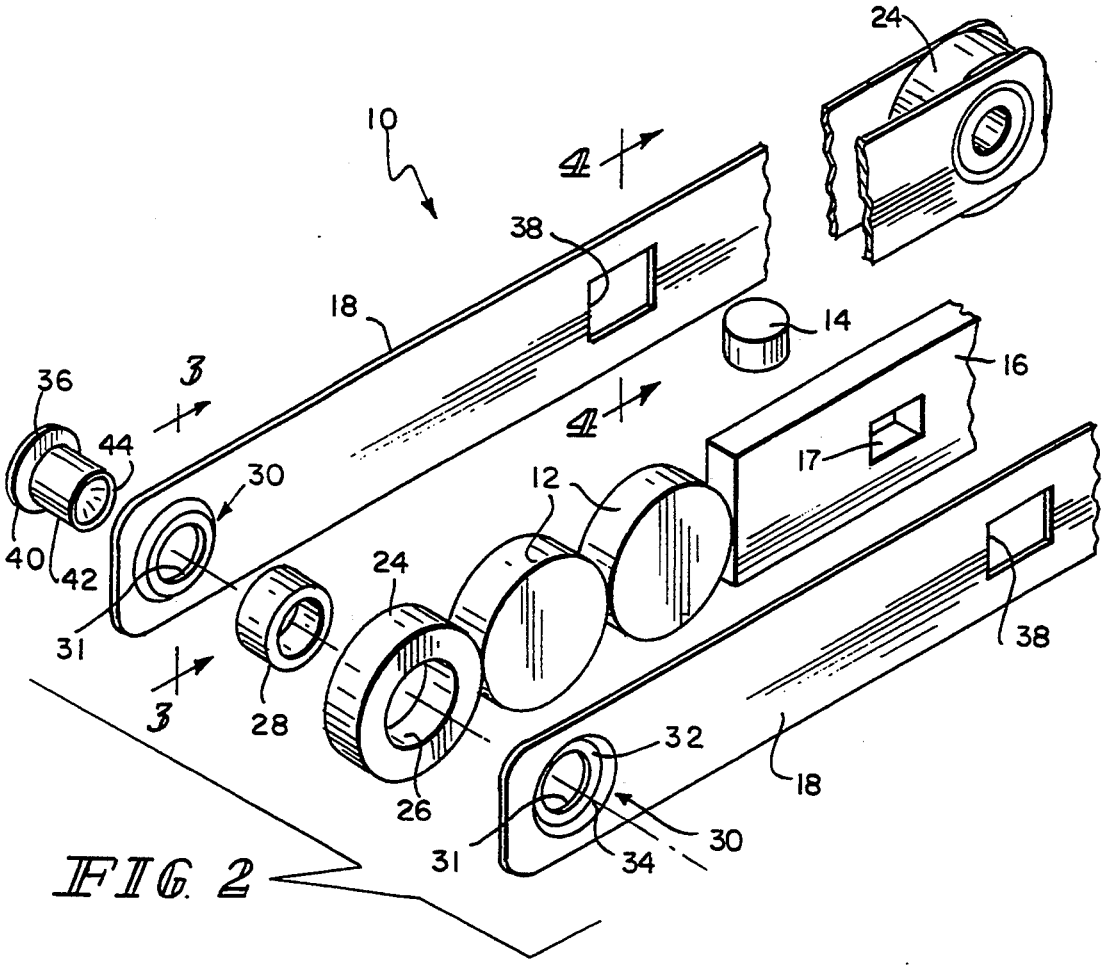
FIG. 2 is an exploded perspective view of a floating roller retainer showing vertical and horizontal rollers, a spacer, side walls, and a rivet aligned for positioning in a roller insert.

As seen in the exploded view of FIG. 2, the floating roller assembly 10 includes a plurality of vertical rollers 12, a pair of end vertical rollers 24, each having a central aperture 26, a horizontal roller 14, a spacer 16 having an aperture 17, a pair of side walls 18 having coined segments 30, an annular roller insert 28, and a conventional rivet 36. The roller inserts 28 are sized to move freely in the central apertures 26 of the end rollers 24. Rivets 36 are configured to pass through the roller inserts 28 to engage the coined segments 30 of the side walls 18 and hold the side walls 18 adjacent the roller inserts 28. Thus, the end rollers 24 are coupled to the side walls 18, providing a region therebetween for the placement of the remaining vertical rollers 12 and spacer 16, and the roller inserts 28 and the coined segments 30 cooperate to define the separation between the side walls 18. Advantageously, coupling the end rollers 24 to the side walls 18 keeps all of the rollers 12, 24 together and prevents the end rollers 24 from lagging behind the rest of the rollers 12 during extension and retraction of the slide assembly 10.

The vertical rollers 12 are circular discs oriented to rotate about a horizontal axis, and the horizontal roller 14 is a circular disc oriented to rotate about a vertical axis. The height of the spacer 16 is slightly less than the diameter of the vertical rollers 12, so that the spacer 16 rests between the interconnected slide members 22, 122, 222 (FIG. 1) without providing any vertical support so as to minimize friction between the interconnected slide members 22, 122, 222 and the spacer 16. The thickness of the spacer 16 is substantially equal to the thickness of the vertical rollers 12 so as to fit between the side walls 18. The length of the spacer 16 is arbitrary, depending on the requirements of the application and the number of rollers 12 to be used.

The spacer 16 includes a rectangular aperture 17 extending transversely therethrough for receiving the horizontal roller 14. Spacer 16 and aperture 17 are illustratively rectangular, but can be any shape. Moreover, the roller 14 could be replaced by a ball bearing without departing from the scope of the present invention. The only requirement of the roller 14 or ball bearing is that it's diameter be greater than the lateral separation of the side walls 18 so as to extend beyond the side walls 18.

The side walls 18 extend longitudinally along the vertical rollers 12, the spacer 16, and a portion of each end vertical roller 24. The side walls 18 include an aperture 38 positioned to be aligned with the aperture 17 formed in the spacer 16. The apertures 17, 38 are sized to allow a horizontal roller 14 to freely rotate therein while extending beyond the plane of the side walls 18. Thus, the horizontal rollers 14 limit the lateral movement available to, and provide lateral separation between, the slide members 22, 122, 222, and therefore eliminate squeezing of the vertical rollers 12 by the slide members 22, 122, 222.

As shown in the exploded view of FIG. 2, the vertical rollers 12 and the spacer 16 are aligned longitudinally, with the spacer 16 dividing the vertical rollers 12 into two groups. Each group of rollers has an arbitrary number of rollers, depending on the application, and includes an end vertical roller 24 having a central aperture 26. An annular roller insert 28 is positioned to be inserted into the central aperture 26. The roller insert 28 has a length substantially equal to the thickness of the end vertical rollers 24 and an outside diameter somewhat less than the diameter of the central apertures 26. Thus the roller inserts 28 are sized to loosely fit into the central apertures 26 to allow the roller inserts 28 to "float" in the end vertical rollers 24.

Each side wall 18 includes a conventional coined segment 30 near each end for engaging the roller inserts 28. The coined segments 30 include a central aperture 31 surrounded by an annular portion 32. The diameter of the central aperture 31 is substantially equal to the inside diameter of the roller insert 28. The annular portion 32 is offset a predetermined amount from the plane of the side wall 18 by a transition portion 34 which connects the annular portion 32 to the side wall 18. The coined segments 30 are configured to be coupled to the roller inserts 28 and each other by the rivets 36 while allowing the end vertical rollers 24 to rotate freely. The transition portion 34 permits the side walls 18 to engage the roller inserts 28 to hold the end rollers 28 in place, while allowing free movement of the end roller 24 about the roller insert 28.

It has been found to be advantageous to allow a small gap between each vertical roller 12, 24 and the spacer 16. Without a gap, the rollers 12, 24 and the spacer rub 16 against each other, increasing friction and wear. Furthermore, the vertical rollers 12, 24 can be pressed together by the impact caused when the telescoping slide assembly 20 reaches the end of its extension or retraction travel, potentially causing flat spots, at least temporarily, on the vertical rollers 12, 24. A small gap between the vertical rollers 12, 24 and the spacer 16 reduces friction and allows the roller assembly 10 to absorb the impact that occurs when the telescoping slide assembly 20 reaches the end of its extension or retraction travel. An adequate gap can be provided by the selection of the appropriate length of the side walls 18 and spacer 16 and the number of vertical rollers 12. In addition, the size difference between the roller insert 28 and the center aperture 26 in the end vertical rollers 24 contributes to the gap. An appropriate gap allows the rollers to contact each other and temporarily deform while stopping the slide assembly at the end of its extension or retraction travel, yet allows the side walls 18 to float in the end rollers 24 without being squeezed, thereby eliminating the accordian effect which could lock up the slide assembly.

To construct the floating roller retainer assembly 10, the spacer 16 is positioned between, and longitudinally aligned with, the vertical rollers 12, 24. The horizontal roller 14 is positioned in the aperture 17 of the spacer 16 and oriented for rotation about a vertical axis. The end vertical rollers 24, with the roller inserts 28 in the central apertures 26, are positioned at the ends of the groups of vertical rollers 12. The side walls 18 are then placed adjacent the vertical rollers 12 and the spacer 16 so as to align the aperture 38 in the side wall 18 with the aperture 17 in the spacer 16 and the horizontal roller 14 and align the coined segments 30 with the roller inserts 28. The rivets 36 are then positioned between the coined segments 30 to extend through the roller inserts to couple the side walls 18 to each other and to the end vertical rollers 24. The rivets 36 are swaged in a conventional manner.

Figure 3:
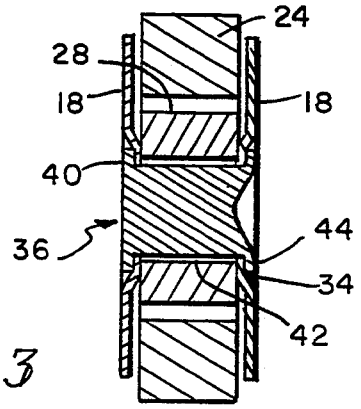
FIG. 3 is a vertical sectional view taken along lines 3—3 of FIG. 2 (assembled) through an end roller.

Rivets 36 have a head 40, a shaft 42 and a tail 44. The head 40 is sized and configured to fit in the transition portion 34 of a coined segment 30 without extending beyond the side walls 18. The tail 44 is swaged so as to fit within the transition portion 34 of a coined segment 30. The shaft 36 is sized to allow the rivet 36 to extend between coined segments 30 and through a roller insert 28 placed therebetween without extending beyond the side walls 18, yet holding the side walls rigidly to the roller insert 28. As shown in FIG. 3, the depth of the transition portion 34 is at least as great as the thickness of the rivet head 40 and of the rivet tail 44 (when swaged). The length of the rivet 36 is selected to allow the rivet 36 to extend through the coined segments 30, but not extend beyond the planes of the side walls 18 when swaged.

When assembled, the roller assembly 10 can be installed into a telescoping assembly 20, as shown in FIG. 1. A preferred telescoping slide assembly 20 includes a plurality of U-shaped slide members 22, 122, 222. A slide assembly 20 suitable for use with the present invention is described in U.S. Pat. No. 3,450,446 to Fall et al., the disclosure of which is incorporated herein by reference.

A stationary slide member 22 is rigidly fixed to a floor or mobile platform (not shown). An intermediate slide member 122 is slidably nested in the stationary slide member 22 for longitudinal movement therein. A load-carrying slide member 222 is slidably nested in the intermediate slide member 122 for longitudinal movement therein. Thus the intermediate slide member 122 interconnects the stationary and load-carrying slide members 22, 222. Illustratively, the load-carrying slide member 222 includes a top plate 58 having a plurality of apertures 60 for attaching a load to the load-carrying slide member 222.

Each slide member 22, 122, 222 includes a pair of opposing side walls 40, 140, 240, respectively, extending upwardly from a bottom wall 42, 142, 242, respectively. The side walls 140, 240 formed on the intermediate and load-carrying slide members 122, 222, respectively, include axially extending tracks 144, 244 respectively. A rectangular recess 46, 146 is formed on the inwardly facing surfaces of each side wall 40, 140 of the stationary and intermediate slide members 22, 122, respectively. Each recess 46, 146 has a lower surface 48, 148 and upper surface 50, 150. Each recess 46, 146 extends substantially along the length of the slide members 22, 122, and is deep enough to accommodate the width of the tracks 144, 244. A notch 52, 152 is formed in one end of each side wall 40, 140 for receiving the tracks 144, 244, respectively, and permitting the tracks 144, 244 to extend into the recess 46, 146. Thus, the tracks 144, 244 and the recesses 46, 146 cooperate to define a pair of track channels 54, 56, 154, 156 in each recess 46, 146.

As shown in FIG. 1, a roller assembly 10 is positioned in each track channel 54, 56, 154, 156. A roller assembly 10 is positioned between the lower surfaces 48, 148 and the tracks 144, 244, respectively, and between the tracks 144, 244 and the upper surfaces 50, 150, respectively. Thus, each track 144, 244 is supported between two roller assemblies 10 for longitudinal movement of the slide members 122, 222 relative to slide member 22.

Figure 4:
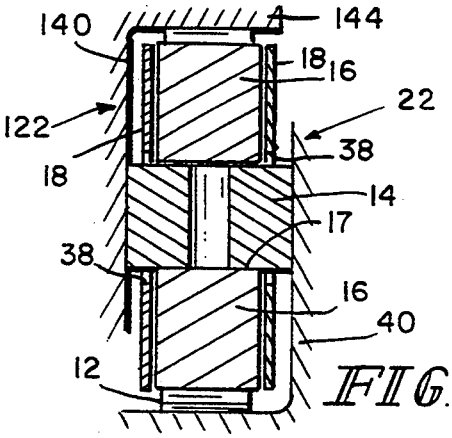
FIG. 4 is a vertical sectional view taken along lines 4—4 of FIG. 2 (assembled) through the spacer and horizontal roller.

As seen in FIG. 4, a roller assembly 10 is illustratively positioned in track channel 54 formed in side wall 40 of slide member 22. The horizontal roller 14 extends beyond the side wall 18 of the roller assembly 10 and between the side walls 40 and 140 of slide members 22, 122, respectively. The horizontal roller 14 thereby maintains lateral separation between the slide members 22, 122 and prevents the slide members 22, 122 from squeezing the side walls 18 and increasing friction in the slide assembly 20.

Although the invention has been described in detail with reference to a certain preferred embodiment, variations and modifications exist within the scope and spirit of the invention as described and defined in the following claims.

We claim:

1. A roller assembly for use in a telescoping slide assembly having at least two slide members that are slidably interconnected for movement along the longitudinal axis of the slide assembly, the roller assembly comprising first means for maintaining vertical spacing between the interconnected slide members, second means for maintaining lateral spacing between the interconnected slide members, the second means including a Spacer formed to include a first vertical side wall having a first opening, a second vertical side wall having a second opening, and a laterally extending open-ended aperture interconnecting the first and second openings, the second means further including a bearing loosely received in the laterally extending open-ended aperture for lateral sliding movement relative to the spacer and arranged to extend through each of the first and second openings, and third means for longitudinally aligning the first means.

2. The roller assembly of claim 1, further comprising means for coupling the third means to the first means.

3. The roller assembly of claim 1, wherein the first means includes a plurality of rollers and the third means includes side wall means positioned to lie adjacent to the rollers for longitudinally aligning the rollers so that the rollers roll along the same path without overlapping.

4. The roller assembly of claim 3, wherein each roller is a round disk and the spacer has a rectangular shape.

5. The roller assembly of claim 4, wherein each roller has a predetermined diameter and the spacer has a vertical height that is less than the predetermined diameter.

6. The roller assembly of claim 4, wherein the spacer is formed to include a rectangular inner edge defining the laterally extending open-ended aperture and the bearing is a round disk.

7. The roller assembly of claim 3, wherein the side wall means includes first and second longitudinally extending side walls positioned in spaced-apart relation to trap the rollers and the spacer therebetween, the first longitudinally extending side wall is formed to include a first outside aperture lying adjacent to the first opening in the first vertical side wall and receiving a portion of the bearing therein, and the second longitudinally extending side wall is formed to include a second outside aperture lying adjacent to the second opening in the second vertical side wall and receiving another portion of the bearing therein.

8. The roller assembly of claim 3, further comprising means for coupling the first means to the third means, the plurality of rollers including a pair of end rollers, each end roller having a central aperture, and the coupling means including insert means for extending through the central aperture to engage the side wall means.

9. The roller assembly of claim 8, wherein the plurality of rollers further include first and second sets of floating rollers unconnected to the adjacent first and second longitudinally extending side walls, the first set of floating rollers including a first floating roller touching one of the end rollers and a second floating roller touching one end of the spacer, and the second set of floating rollers including a third floating roller touching another end of the spacer and a fourth floating roller touching another of the end rollers.

10. The roller assembly of claim 1, wherein the first means includes a plurality of rollers and the third means includes a pair of longitudinally extending side walls positioned to lie adjacent to the rollers and in spaced-apart relation to one another so as to longitudinally align the rollers so that the rollers roll along the same path without overlapping.

11. The roller assembly of claim 10, wherein each longitudinally extending side wall includes means for receiving the bearing and the bearing is oriented for rotation in the laterally extending open-ended aperture about a vertical axis and is sized to extend beyond the longitudinally extending side walls.

12. The roller assembly of claim 1, wherein the first means includes a plurality of vertical rollers oriented for rotation about a horizontal axis, the third means includes a pair of longitudinally extending side walls positioned to lie adjacent to the rollers and in spaced-apart relation to one another, the longitudinally extending side walls each including means for receiving the bearing, the bearing is oriented for rotation in the laterally extending open-ended aperture about a vertical axis, and the bearing is sized to extend beyond the longitudinally extending side walls.

13. A roller assembly for use in a telescoping slide assembly having at least two slide members that are slidably interconnected for movement along the longitudinal axis of the slide assembly, the roller assembly comprising first means for use in maintaining vertical spacing between the interconnected slide members, second means for use in maintaining lateral spacing between the interconnected slide members, third means for longitudinally aligning the first means, the first means including a plurality of rollers and the third means including side wall means positioned adjacent the rollers to longitudinally align the rollers so that the rollers roll along the same path without overlapping, and means for coupling the first means to the third means, the plurality of rollers including a pair of end rollers, each end roller having a central aperture, the coupling means including insert means for extending through the central aperture to engage the side wall means, the side wall means including longitudinally extending side walls positioned to lie adjacent to the rollers and in spaced-apart relation to one another, each side wall including a coined segment for engaging the insert means, the coined segment cooperating with the insert means to position the side walls in spaced-apart relation to one another.

14. The roller assembly of claim 13, wherein the coupling means further includes rivet means for extending through the insert means to engage the coined segment of the side wall and position the insert means between the side walls.

15. A roller assembly for use in a telescoping slide assembly having at least two slide members that are slidably interconnected for movement along the longitudinal axis of the slide assembly, the roller assembly comprising first means for use in maintaining vertical spacing between the interconnected slide members, second means for use in maintaining lateral spacing between the interconnected slide members, and third means for longitudinally aligning the first means, the first means including a plurality of vertical rollers oriented for rotation about a horizontal axis, the third means including pair of longitudinally extending side walls positioned adjacent the rollers, the side walls including means for receiving the second means, and the second means including a bearing oriented for rotation about a vertical axis, the bearing extending beyond the side walls, the plurality of rollers including a pair of end rollers, each end roller having a central aperture, and the side walls including a coined segment for coupling the side walls to the end rollers.

16. The roller assembly of claim 15, further comprising insert means for separating the side walls, wherein the insert means engages the coined segments to define the separation between the side walls.

17. A roller assembly for use in a telescoping slide assembly having at least two slide members that are slidably interconnected for movement along the longitudinal axis of the slide assembly, the roller assembly comprising first means for reducing friction, the first means being oriented for rotation about a horizontal axis, second means for reducing friction, the second means being oriented for rotation about a vertical axis, and third means for longitudinally aligning the first means, the third means including first and second longitudinally extending side walls positioned in spaced-apart relation to position portions of the second means therebetween, the second means moving laterally relative to the first means while rotating about the vertical axis and extending laterally beyond the first and second longitudinally extending side walls.

18. The roller assembly of claim 17, wherein the first means includes a plurality of vertical rollers, the second means includes a bearing, and the first and second longitudinally extending side walls are positioned to lib adjacent to the rollers and to trap the rollers therebetween.

19. A roller assembly for use in a telescoping slide assembly having at least two slide members that are slidably interconnected for movement along the longitudinal axis of the slide assembly, the roller assembly comprising first means for reducing friction, the first means being oriented for rotation about a horizontal axis, second means for reducing friction, the second means being oriented for rotation about a vertical axis, and third means for longitudinally aligning the first means, the second means extending laterally beyond the third means, the first means including a plurality of vertical rollers, the second means including a bearing, and the third means including a pair of longitudinally extending side walls positioned adjacent the rollers, the plurality of vertical rollers including a pair of end rollers, each end roller having a central aperture, and the side walls including a coined segment for coupling the side walls to the end rollers and means for receiving the bearing.

20. The roller assembly of claim 19, further comprising insert means for extending through the central aperture and engaging coined segments to define the separation between the side walls.

21. A roller assembly for use in a telescoping slide assembly having at least two slide members that are slidably interconnected for movement along the longitudinal axis of the slide assembly, the roller assembly comprising first means for reducing friction, the first means being oriented for rotation about a horizontal axis, second means for reducing friction, the second means being oriented for rotation about a vertical axis, third means for longitudinally aligning the first means, the second means extending laterally beyond the third means, and means for coupling the first means to the third means, the first means including a pair of end rollers, each end roller including a central aperture, and the coupling means including a rivet extending through the central aperture.

22. The roller assembly of claim 21, further comprising insert means for extending through the central aperture, wherein the third means includes side walls having coined segments, the rivet extending through the insert means to engage the coined segments.

23. The roller assembly of claim 22, wherein the insert means and the coined segments cooperate to define the separation between the side walls.

24. A roller assembly for use in a telescoping slide assembly having a first slide member movably nested in a second slide member for movement along a longitudinal axis, the assembly comprising a plurality of vertical rollers for supporting the first slide member in the second slide member, the vertical rollers being oriented to rotate about a horizontal axis, a bearing for maintaining lateral separation between the first slide member and the second slide member, the bearing being oriented for rotation about a vertical axis, means for retaining the bearing in position relative to the vertical rollers, the retaining means including a bearing and a spacer positioned between the vertical rollers, the spacer being formed to include a first vertical side wall having a first opening, a second vertical side wall having a second opening, and a laterally extending open-ended aperture interconnecting the first and second openings and loosely receiving the bearing therein for lateral sliding movement relative to the spacer, and means coupled to the vertical rollers for maintaining the vertical rollers in longitudinal alignment so that the vertical rollers roll along the same path without overlapping.

25. The roller assembly of claim 24, wherein the maintaining means includes a pair of spaced-apart side walls, each side wall having an aperture positioned to be aligned in coaxial relation with the laterally open-ended extending aperture in the spacer.

26. The roller assembly of claim 24, wherein the maintaining means includes a pair of longitudinally extending side walls positioned on either side of the vertical rollers, and the bearing is sized to extend laterally beyond the side walls to provide lateral separation between the first and second slide members.

27. The roller assembly of claim 24, wherein the maintaining means includes a pair of opposing side walls and means for coupling the side walls to end rollers to maintain the vertical rollers in relative longitudinal positions.

28. A roller assembly for use in a telescoping slide assembly having a first slide member movably nested in a second slide member for movement along a longitudinal axis, the assembly comprising a plurality of vertical rollers for supporting the first slide member in the second slide member, the vertical rollers being oriented to rotate about a horizontal axis, a bearing for maintaining lateral separation between the first slide member and the second slide member, the bearing being oriented for rotation about a vertical axis, means for retaining the bearing in position relative to the vertical rollers, means coupled to the vertical rollers for maintaining the vertical rollers in longitudinal alignment so that the vertical rollers roll along the same path without overlapping, the maintaining means including a pair of longitudinally extending side walls positioned on either side of the vertical rollers, the bearing being sized to extend laterally beyond the side walls to provide lateral separation between the first and second slide members, the maintaining means including a pair of opposing side walls and means for coupling the side walls to end rollers to maintain the vertical rollers in relative longitudinal positions, the vertical rollers including end rollers each end roller having a central aperture, and a roller insert sized and configured to fit in and extend through each central aperture to engage the side walls and define the separation between the side walls.

29. The roller assembly of claim 28, wherein the side walls include coined segments extending laterally inwardly from the side walls and configured to engage the roller inserts to rotatably maintain the end rollers in position between the side walls.

30. A roller assembly for use in a telescoping slide assembly having at least two slide members that are slidably interconnected for movement along the longitudinal axis of the slide assembly, the roller assembly comprising a roller cage including first and second longitudinally extending side walls positioned in spaced-apart relation to define an elongated channel therebetween, each of the first and second longitudinally extending side walls including a forward end and an opposite rearward end, a forward end roller positioned to lie in the elongated channel and rotatably coupled to the forward ends of the longitudinally extending side walls, and a rearward end roller positioned to lie in the elongated channel in spaced-apart relation to the forward end roller and rotatably coupled to the rearward ends of the longitudinally extending side walls, a rectangular spacer positioned in the elongated channel to lie between the first and second end rollers, a first set of vertical rollers positioned in the elongated channel to lie between the first end roller and the rectangular spacer, and a second set of vertical rollers positioned in the elongated channel to lie between the rectangular spacer and the second end roller.

31. The roller assembly of claim 30, wherein each vertical roller is a round disk having a predetermined diameter and the spacer has a vertical height that is less than the predetermined diameter.

32. The roller assembly of claim 30, wherein the spacer is formed to include a rectangular inner edge defining a laterally extending open-ended aperture and further comprising a bearing disposed in the laterally extending open-ended aperture.

33. The roller assembly of claim 32, wherein the spacer is formed to include a first vertical side wall having a first opening, a second vertical side wall having a second opening communicating with the first opening via the laterally extending open-ended aperture, the bearing is loosely received in-the laterally extending open-ended aperture for lateral sliding movement relative to the spacer and rotation about a vertical axis, and the bearing is arranged to extend through each of the first and second openings.

34. The roller assembly of claim 33, wherein the first longitudinally extending side wall is formed to include a first outside aperture lying adjacent to the first opening in the vertical side wall and receiving a portion of the bearing therein and the second longitudinally extending side wall is formed to include a second outside aperture lying adjacent to the second opening in the second vertical side wall and receiving another portion of the bearing therein.

35. The roller assembly of claim 30, wherein the first set of vertical rollers includes a forward vertical roller touching the forward end roller and a rearward vertical roller touching a forward end of the spacer.

36. The roller assembly of claim 30, wherein the second set of vertical rollers includes a forward vertical roller touching a rearward end of the spacer and a rearward vertical roller touching the rearward end roller.

* * * * *